United States Patent [19]

Hasegawa

[11] 4,308,645

[45] Jan. 5, 1982

[54] SEPARABLE SLIDE FASTENER

[75] Inventor: Akira Hasegawa, Kurobe, Japan

[73] Assignee: Yoshida Kogyo K.K., Tokyo, Japan

[21] Appl. No.: 80,705

[22] Filed: Oct. 1, 1979

[30] Foreign Application Priority Data

Oct. 9, 1978 [JP] Japan ..... 53-138000

[51] Int. Cl.[3] ..... A44B 19/36

[52] U.S. Cl. ..... 24/205.11 R; 24/205.11 F

[58] Field of Search ..... 24/205.11 R, 205.11 F

[56] References Cited

U.S. PATENT DOCUMENTS

| | | | |
|---|---|---|---|
| 2,835,951 | 5/1958 | Sutton et al. | 24/205.11 R |
| 2,951,285 | 9/1960 | Law | 24/205.11 R |
| 2,989,802 | 6/1961 | McNamara | 24/205.11 R |
| 3,485,691 | 12/1969 | Waldes | 24/205.11 F X |
| 3,752,718 | 8/1973 | Potin | 24/205.11 F X |
| 3,845,526 | 11/1974 | Kawakami | 24/205.11 R X |
| 3,964,136 | 6/1976 | Panzeri | 24/205.11 R |
| 4,023,241 | 5/1977 | Kanzaka | 24/205.11 F |
| 4,047,264 | 9/1977 | Takahashi | 24/205.11 R |

*Primary Examiner*—Roy D. Frazier
*Assistant Examiner*—Peter A. Aschenbrenner
*Attorney, Agent, or Firm*—Hill, Van Santen, Steadman, Chiara & Simpson

[57] ABSTRACT

A separable slide fastener which includes a pair of stringers, a pair of pin members each secured at one end portion of one stringer, and a retainer for separably closing said pin members to each other is disclosed. The retainer may be a slidable one wherein the retainer can slide over both stringers and receive both pin members therein or a fixed one which includes a box having an opening for receiving the other pin member therein fixed to one of the pin members. The pin members are modified fastener elements formed by cutting the coupling heads off from some of the fastener elements positioned at one end portion of each stringer.

8 Claims, 4 Drawing Figures

SEPARABLE SLIDE FASTENER

BACKGROUND OF THE INVENTION

This invention relates to a separable slide fastener.

Heretofore, separable slide fasteners were known and widely used. Usually, these separable slide fasteners include a pair of stringers on each of which fastener elements are secured, a pair of pin members each secured at the bottom end portion of one stringer and a retainer for separably closing pin members to each other at the bottom end portions of the stringers. The retainer may be a slidable one wherein the retainer can slide over both stringers and receive both pin members therein. In a retainer of such type the stringers can be separated from the bottom by sliding the retainer from the bottom upwards. One example of such separable slide fastener using a slidable retainer is disclosed in U.S. Pat. No. 2,553,230. Alternatively, the retainer may be a fixed one which includes a box fixed to one of the pin members. The box includes an opening for receiving the other pin member therein to hold the stringers in alignment.

However, in any of the separable slide fasteners of the known type the pin members are formed independently of the fastener elements out of metal or synthetic resin material and are secured to the end portions of the stringers by specific securing methods. Therefore, production of slide fasteners of the known type is relatively complex and expensive. Also, the pin members of these known types of fasteners are formed in one piece from rigid metal or synthetic resin material. Therefore, they have no flexibility and cannot easily be made to follow the curved guide channel of the slidable retainer or the curved walls of the opening of the fixed retainer. Therefore, such pin members cannot be smoothly inserted in or easily removed from these slidable or fixed retainers.

SUMMARY OF THE INVENTION

Therefore, an object of this invention is to provide a separable slide fastener which can be produced easily and at low cost.

Another object of this invention is to provide a separable slide fastener whereby the pin members can be smoothly inserted in and removed from the slidable or fixed retainer.

The present invention may be summarized as a separable slide fastener including a pair of stringers, a pair of pin members each secured at one end portion of one stringer, and a retainer for separably closing the pin members to each other, the retainer may be a slidable one wherein the retainer can slide over both stringers and receive both pin members therein or a fixed one which includes a box having an opening for receiving the other pin member therein fixed to one of the pin members and characterized in that the pin members are modified fastener elements formed by cutting the coupling heads off from some of the fastener elements positioned at one end portion of each stringer.

DETAILED DESCRIPTION OF THE PREFERRED EMBODIMENTS

Figure 1:
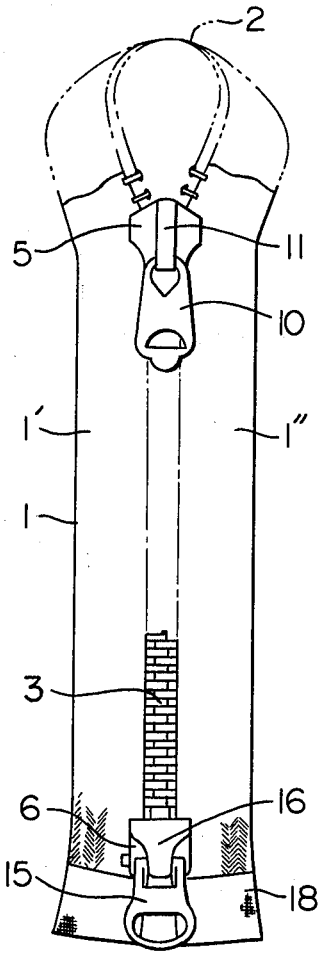
FIG. 1 is an overall plane view of one preferred embodiment of the invention.
Figure 2:
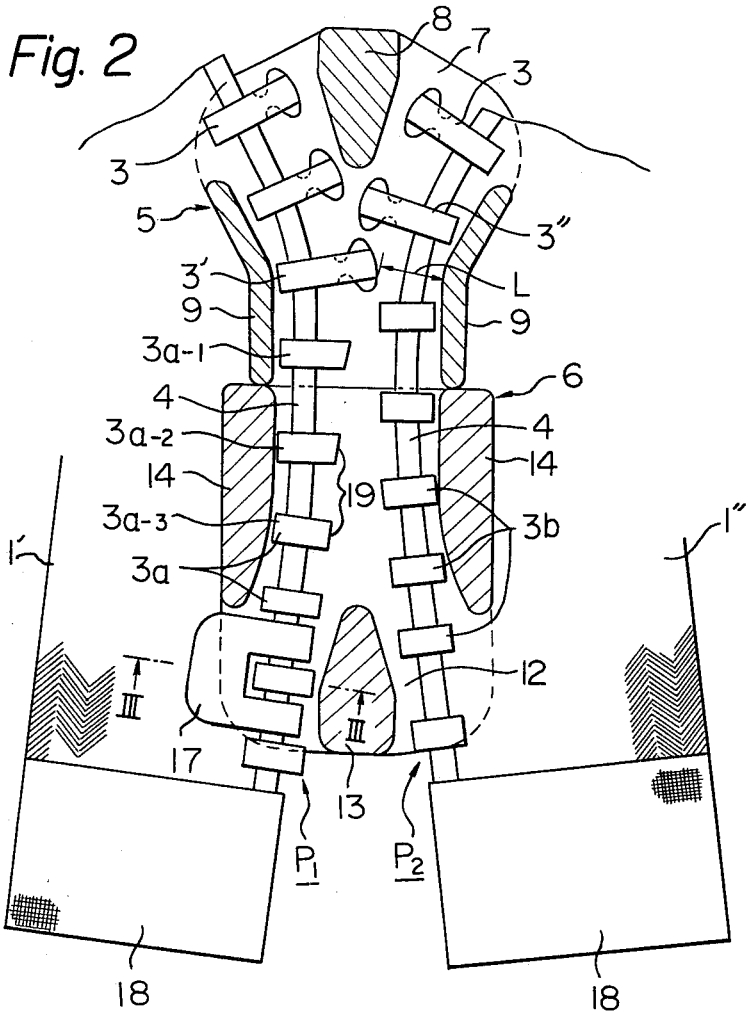
FIG. 2 is a horizontal sectional view of the main portion of FIG. 1 with both sliders moved close to each other.
Figure 3:
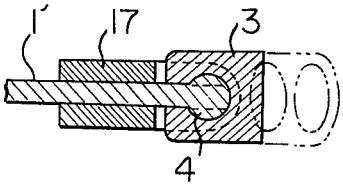
FIG. 3 is a sectional view taken along line III—III of FIG. 2.

Hereinafter, several preferred embodiments of this invention will be explained with reference to the drawings. The two embodiments of the invention shown here are related to slide fasteners separable from the top and bottom. Referring to FIGS. 1 and 2, a single stringer 1 is folded back at the mid portion 2 thereof to form a pair of opposing stringers 1', 1''. As shown in FIG. 2, a row of fastener elements 3 is attached to a beaded edge 4 of each stringer as in the usual fastener stringer. A pair of sliders 5, 6 is mounted on these stringers 1', 1'' with their stem ends toward each other so that movement of one slider toward the other disengages the fastener elements 3, 3 and movement in the other direction engages the fastener elements. The sliders 5 and 6 may be of conventional type. Namely, the slider 5 comprises the usual spaced top and bottom plates or wings 7, 7 (only bottom plate 7 is shown) joined at one end by a neck or post 8. Each of these top and bottom plates 7, 7 is provided with flanges 9, 9 on opposite sides thereof. These flanges 9, 9 together with the neck or post 8 form the usual Y-shaped channel. A pull tab 10 is attached to a lug 11 formed on the top plate (FIG. 1). Like the slider 5, the slider 6 comprises top and bottom plates or wings 12, 12 (only bottom plate 12 is shown), a neck or post 13, flanges 14, 14 and a pull tab 15 attached to a lug 16 formed on the top plate. A bottom stop 17 is secured to the bottom portion of the stringer 1' to prevent sliding off of the slider 6 from the stringer 1'. Reinforced bands 18, 18 are attached to the bottom end portion of stringers 1', 1''.

As shown in FIG. 2, some of the fastener elements **3*a*, 3*b* at the bottom end portions of each stringer 1', 1'' are modified by cutting off the coupling head from these fastener elements. Each of these rows of modified fastener elements 3*a*, 3*b* forms a so-called "pin member". Namely, the row of legs remaining on the left stringer 1' forms a first pin member $P_1$ at the bottom portion of the left stringer, and the row of legs remaining on the right stringer 1''** forms a second pin member $P_2$ at the bottom portion of the same.

In the row of modified elements **3*a* which forms the first pin member $P_1$, the height of modified fastener element 3*a*-2 is less than that of modified fastener element 3*a*-1 which is adjacent to the bottom normal fastener element 3'. And preferably, the height of the following modified fastener element 3*a*-3 is less than that of modified fastener element 3*a*-2. With this arrangement the neck 13 of slider 6 can be passed smoothly between these first and second rows of modified elements 3*a* and 3*b* when it is slid up and the slider 6 can be moved with light force. The end surfaces 19 of modified fastener elements 3*a* may be tapered as shown in the drawings so that more smooth movement of the slider 6 can be obtained. The height of each of the modified fastener elements 3*b* which forms the second pin member $P_2$ is made a little less than the distance L between the head of bottom normal fastener element 3' of the left side stringer 1' and inner wall of flange 9 of slider 5. With this arrangement the second pin member $P_2$ can be smoothly inserted in or taken out of the channels of the sliders 5 and 6 despite the existence of the first pin member $P_1$ within channels of these sliders 5, 6**.

Upon assembling of sliders 5 and 6 on the first and second stringers 1' and 1'', the pin members $P_1$, $P_2$ and fastener elements 3 of both stringers 1', 1'' are first threaded through the stem and one branch of the Y-shaped channel of each slider with these stringers 1', 1'' extended in straight line. Then the bottom stop 17 is attached to the bottom portion of the stringer 1' to prevent sliding off of the slider 6 from the stringer 1'. Thereafter, the stringer 1 is folded back at the mid portion 2 thereof as shown in FIG. 1 and the second pin member $P_2$ and fastener elements 3 on the stringer 1'' are threaded through the stem and the other branch of the Y-shaped channel of each slider with both sliders positioned adjacent each other as shown in FIG. 2. Alternatively, the bottom stop 17 may be attached to the stringer 1' before threading of the pin member $P_1$, $P_2$ and fastener elements 3 through the channels of the sliders 5, 6.

As the first and second pin members $P_1$, $P_2$ are constructed as above stated, when the pin members $P_1$, $P_2$ are threaded through the channels of the sliders 5, 6, these pin members $P_1$, $P_2$ can easily be made to follow the curved surfaces of these channels and thus can be smoothly inserted in these sliders. Also, when the second pin member $P_2$ and fastener elements 3 on the stringer 1'' are threaded through the stem and the other branch of the Y-shaped channel of each slider, the bottom normal fastener element 3'' of the stringer 1'' is engaged with the bottom normal fastener element 3' of the stringer 1'; therefore, sliding off of the second pin member $P_2$ through sliders 5, 6 toward bottom is prevented and thereby alignment of both stringers 1', 1'' is maintained.

The slider 5 may then be moved upward to any desired position along the stringers, with the slider 6 left in its downmost position if it is desired that the fastener remain closed at the bottom. If it is desired to open the fastener from the bottom, the slider 6 is moved upwardly to any desired position along the stringers 1', 1''.

When it is desired to fully separate the stringers 1', 1'' from each other, the second pin member $P_2$ on the stringer 1'' is pulled out of the channel of each slider with sliders 5, 6 in contact with each other on the stringer tapes. In this case, as the second pin members $P_2$ has flexibility, the pin member can easily be pulled out of the sliders 5, 6.

Figure 4:
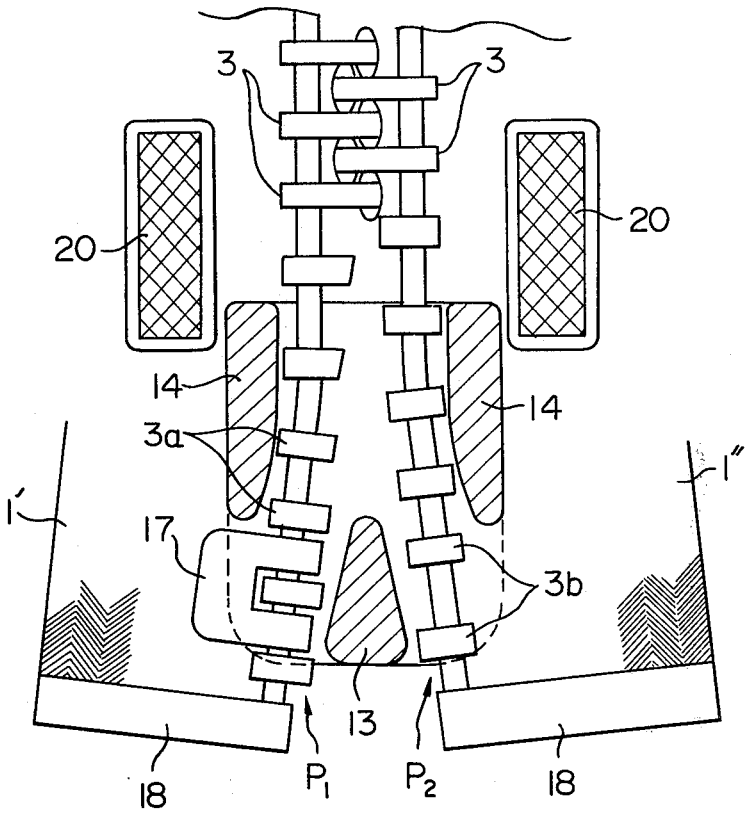
FIG. 4 is a view similar to FIG. 2 but showing another embodiment of the invention with upper slider not shown.

FIG. 4 shows a modified form of the invention. In this embodiment a reinforced band 20 is attached to stringer tape adjacent the boundary region of the normal fastener element 3 and the modified fastener elements 3*a*, 3*b* of each stringer. With this arrangement internal flexing of the stringers 1', 1'' is limited and accidental disengagement of the fastener elements is prevented. The remaining construction is substantially identical with that of the above-mentioned embodiment.

The preferred embodiments above-mentioned are related to slide fasteners which can be opened from the bottom but the invention is not limited to such type of slide fastener and can be applied to the usual type of separable slide fastener wherein pin members are held in closed position by a fixed retainer. In such case slider 6 is replaced by a box which forms a fixed retainer and first pin member $P_1$ is fixed to the box. The box may be formed by removing the lug 16 and the pull tab 15 from slider 6 shown in FIG. 1. The first pin member $P_1$ may be fixed to the inside surface of flange 14 of the box.

Thus, in accordance with the present invention, since the first and second pin members are formed by cutting off coupling heads from some normal fastener elements positioned at the bottom portion of the stringers, the formation of these first and second pin members is easy and does not require any other metal or synthetic resin material. Therefore, this separable slide fastener is easily produced at less cost. Also, since the pin members are formed by separated fastener elements and have flexibility the pin members can easily follow the curved channel surfaces of the sliders or curved opening surfaces of the box and thus smooth insertion into and removal from the slider or box can be effected. Further, since the bottom normal fastener element of one stringer is engaged by the lowermost normal fastener element of the other stringer and sliding off of the second pin member from the sliders toward bottom is prevented, the second pin member can be properly positioned without using a specific stopper therefor. And, further, this invention can be easily applied to both types of separable fastener, i.e., the slidable retainer type and fixed retainer type.

What is claimed is:

1. A separable slide fastener comprising a pair of stringers, a pair of pin members each secured at one end portion of one stringer, and a retainer for separably closing said pin members to each other, said retainer being a slidable one wherein the retainer can slide over both stringers and receive both pin members therein, said pin members being modified fastener elements formed by cutting the coupling heads off from some normal fastener elements positioned at one end portion of each stringer, wherein the end surface of at least the modified fastener element adjacent the normal fastener elements of one pin member is tapered.

2. A separable slide fastener comprising a pair of stringers, a pair of pin members each secured at one end portion of one stringer, and a retainer for separably closing said pin members to each other, said retainer being a slidable one wherein the retainer can slide over both stringers and receive both pin members therein, said pin members being modified fastener elements formed by cutting the coupling heads off from some normal fastener elements positioned at one end portion of each stringer, wherein the height of the modified fastener element adjacent to the normal fastener element of one pin member is made greater than that of the following modified fastener element of the one pin member, the height of each modified fastener element of the other pin member being selected so that the other pin member can be received within said retainer without engaging said normal fastener element of said one pin member, and a stopper for engaging the slidable retainer is attached to the bottom end of said one pin member.

3. A separable slide fastener as defined by claim 2 wherein the end surface of at least the modified fastener element adjacent the normal fastener elements of one pin member is tapered.

4. A separable fastener as defined by claim 2 wherein a reinforced band is attached to each of said stringers adjacent the boundary region between the normal fastener elements and the modified fastener elements of said stringers.

5. A separable slide fastener comprising a pair of stringers, a pair of pin members each secured at one end portion of one stringer, and a retainer for separably closing said pin members to each other, said retainer being a fixed one which includes a box having an opening for receiving the other pin member therein fixed to one of the pin members, said pin members being modified fastener elements formed by cutting the coupling heads off from some of normal fastener elements positioned at one end portion of each stringer, wherein the end surface of at least the modified fastener element adjacent the normal fastener elements of said one pin member is tapered.

6. A separable slide fastener comprising a pair of stringers, a pair of pin members each secured at one end portion of one stringer, and a retainer for separably closing said pin members to each other, said retainer being a fixed one which includes a box having an opening for receiving the other pin member therein fixed to one of the pin members, said pin members being modified fastener elements formed by cutting the coupling heads off from some of normal fastener elements positioned at one end portion of each stringer, wherein the height of the modified fastener element adjacent to the normal fastener element of said one pin member is made greater than that of the following modified fastener element of the one pin member, the height of each modified fastener element of said other pin member being selected so that the other pin member can be received within said retainer without engaging said normal fastener element of said one pin member.

7. A separable slide fastener as defined by claim 6 wherein the end surface of at least the modified fastener element adjacent the normal fastener elements of said one pin member is tapered.

8. A separable slide fastener as defined by claim 6 wherein a reinforced band is attached to each of said stringers adjacent the boundary region between the normal fastener elements and the modified fastener elements of said stringers.

* * * * *